US010435636B2

(12) United States Patent
Johnson et al.

(10) Patent No.: US 10,435,636 B2
(45) Date of Patent: Oct. 8, 2019

(54) APPARATUS AND METHOD FOR REDUCING FOULING IN CRUDE REFINING BY REDUCTION OF PHOSPHORUS

(71) Applicant: Marathon Petroleum Company LP, Findlay, OH (US)

(72) Inventors: James F. Johnson, Woodhaven, MI (US); Gregory A. Cantley, Huntington, WV (US); Phillip Ryan Adams, Flatwoods, KY (US)

(73) Assignee: Marathon Petroleum Company LP, Findlay, OH (US)

( * ) Notice: Subject to any disclaimer, the term of this patent is extended or adjusted under 35 U.S.C. 154(b) by 253 days.

(21) Appl. No.: 15/452,082

(22) Filed: Mar. 7, 2017

(65) Prior Publication Data

US 2017/0298282 A1 Oct. 19, 2017

Related U.S. Application Data

(60) Provisional application No. 62/321,775, filed on Apr. 13, 2016.

(51) Int. Cl.
*C10G 7/00* (2006.01)
*C10G 75/00* (2006.01)

(52) U.S. Cl.
CPC ..... *C10G 75/00* (2013.01); *C10G 7/00* (2013.01); *C10G 2300/202* (2013.01)

(58) Field of Classification Search
CPC . C10G 75/00; C10G 7/00; C10G 7/06; C10G 7/10; C10G 2300/202; B01D 3/06; B01D 3/32; B01D 3/324
See application file for complete search history.

(56) References Cited

U.S. PATENT DOCUMENTS 4,673,490 A * 6/1987 Subramanian ..... C10G 7/00 208/354
7,172,686 B1 * 2/2007 Ji ..... B01D 3/06 208/251 R
2014/0374322 A1 * 12/2014 Venkatesh ..... C10G 7/00 208/363

FOREIGN PATENT DOCUMENTS

GB 775273 * 5/1957

* cited by examiner

*Primary Examiner* — Prem C Singh
*Assistant Examiner* — Brandi M Doyle
(74) *Attorney, Agent, or Firm* — Schaffer, Schaub & Marriott LTD

(57) ABSTRACT

A method and apparatus for the reduction of fouling in a crude unit. Chemicals containing Phosphorous are understood to be utilized in the production or transportation of certain types of crude oils. It is believed that the elevated levels of phosphorus are contributing to the excessive fouling observed in the preheat exchanger circuits and crude heaters.

1 Claim, 2 Drawing Sheets

APPARATUS AND METHOD FOR REDUCING FOULING IN CRUDE REFINING BY REDUCTION OF PHOSPHORUS

CROSS REFERENCE TO RELATED APPLICATIONS

This application is a conversion of provisional application Ser. No. 62/321,775 filed Apr. 13, 2016. This application is related to application Ser. No. 14/854,641 filed Sep. 15, 2015. The disclosures of the '641 application are expressly incorporated herein.

BACKGROUND OF THE INVENTION

At an oil refinery, crude oil is brought in, generally through a pipeline, at a temperature of approximately 50-70° F. Before the crude oil enters a crude heater, the crude is pre-heated to a desired temperature to optimize the performance of the crude heater and reduce fuel costs. Once the crude oil is pre-heated to a desired temperature of nominally 400° F., it enters a flash drum or flash tower, wherein the lighter hydrocarbons (such as butane, propane and gasoline) are removed from the crude oil by evaporation or flashing. The remaining crude oil is then transferred to the crude heater for further heating prior to separation in the crude tower.

The final products produced (naphtha, diesel fuel, gasoline, asphalt, etc.) must be cooled before being transported to storage. One method of cooling passes the product through heat exchange equipment, whereby the temperature of the finished product is cooled and the temperature of the crude oil is increased. Any number of heat exchangers can be utilized to reach the desired temperature of the crude, and to reduce the temperature of the product. A furnace is then utilized to further heat the crude oil prior to entering the crude tower for fractionation. To increase efficiency of this heat exchange process it is common for refineries to utilize a flash drum or flash tower that is installed mid-way through the heat exchange process. This equipment allows light hydrocarbons, and contaminants such as water, to flash or be released from the oil, as further heating of this material is not required. The removal, by flashing, of the light material and contaminants increases the efficiency of the further heat exchanging equipment and furnace.

It is well known that fouling in the preheat circuit, progressively worsens as the crude temperature increases, cumulating with the most extensive fouling being observed in the crude heater. Fouling has also been observed in kerosene sections of the crude tower with excessive levels of phosphorus not normally expected nor historically observed in the foulants. Samples of the coke obtained from the pre-heat exchangers and crude heaters indicate these elevated levels of phosphorus. Phosphorus is known to reduce corrosion. Chemicals containing Phosphorous are understood to be found in the production or transportation of certain types of crude oils. It is believed that the elevated levels of phosphorus are contributing to the excessive fouling observed in the preheat exchanger circuits and crude heaters.

The removal of the additional contaminants and light hydrocarbons, specifically kerosene at the flash tower or flash drum, results in lower phosphorus levels downstream in the crude heater and other vessels. This reduction in phosphorus has been shown to decrease unwanted fouling in downstream vessels.

This reduction in light hydrocarbons reduces the phosphorus found in the crude thereby reducing fouling in the crude heater and downstream vessels.

THE SUMMARY OF THE INVENTION

The present invention provides an apparatus and method for the reduction of fouling in the refining of crude oil due to phosphorous. In a typically designed crude preflash tower, any liquid that is flashed on entry into the tower will drop back down to the bottom of the tower by refluxing. The range of hydrocarbon that is believed to contain the material, phosphorous, that leads to fouling of the preheat circuit is prevented from falling to the bottom of the tower. The hydrocarbon carrying the phosphorous thus is kept out of the preheat circuit to which the bottoms are routed. The tower bottoms are made up of a full range of crude oil that are flashed at the inlet temperature of the flash tower. This is the normal range of hydrocarbon described as naphtha. When these hydrocarbons vaporize or flash they carry some amount of heavier hydrocarbons up the tower with them. This heavier hydrocarbon range is described as kerosene and is believed to contain molecules (i.e. phosphorous) that lead the fouling of the downstream components. The present invention prevents these heavier hydrocarbons from washing down to the bottoms by refluxing. The heavier hydrocarbons that are carried by the light hydrocarbons to the top of the flash tower are collected by fractionation trays and are routed past the heating circuit, often directly to the crude tower, bypassing the downstream vessels that normally experience significant fouling. By directing the heavier hydrocarbons containing the phosphorous around the preflash exchanger train and the crude heater, phosphorous levels are decreased in the preflash exchanger train and the crude heater, resulting in significantly less fouling of the components.

Therefore, an object of the invention is to reduce phosphorous fouling of the preflash exchanger train and the crude heater. Other objects and advantages of the present invention will become apparent to those skilled in the art upon a review of the following detailed description of the preferred embodiments and the accompanying drawings.

IN THE DRAWINGS

DETAILED DESCRIPTION OF THE INVENTION

Figure 1:
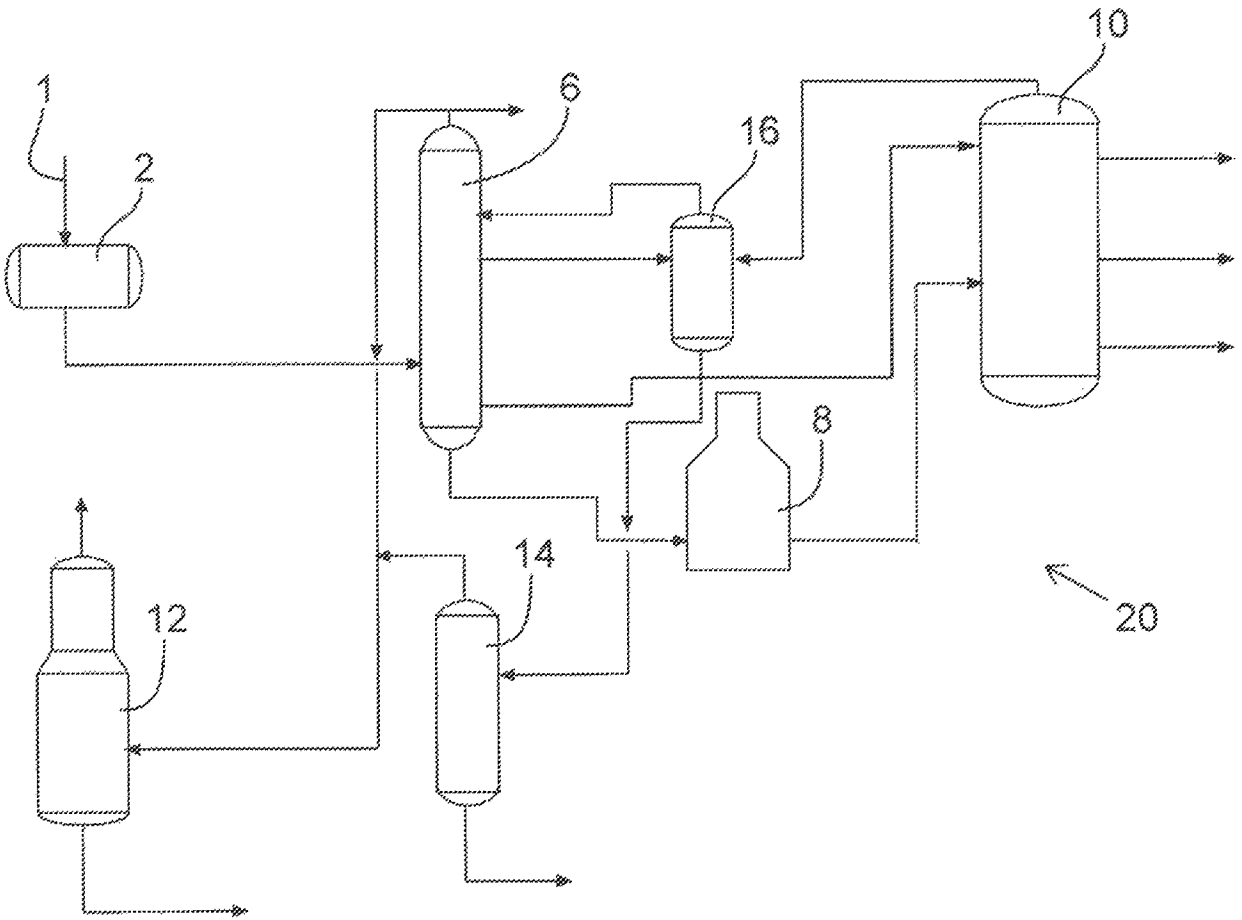
FIG. 1 is a schematic drawing a typical crude unit, including a flash separator with a draw tray, of the present invention.
Figure 3:
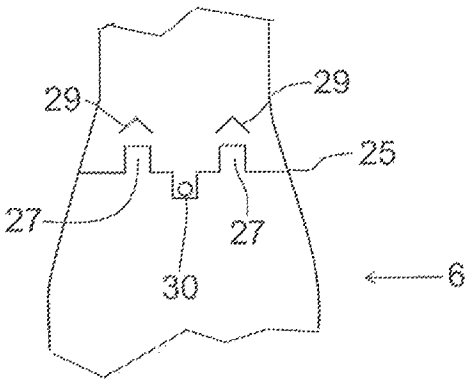
FIG. 3 is a cross section view of a flash tower showing the metal draw tray in more detail.
Figure 2:
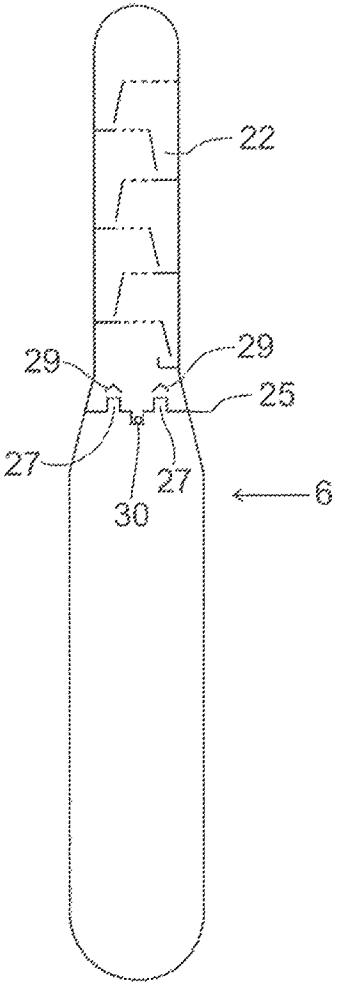
FIG. 2 is a cross section view of a flash tower having a total draw tray.

Referring now to FIGS. 1-3, the crude oil 1, or raw crude, enters the refinery from a pipeline at ground temperature of about 50-70° F. The crude oil 1 is stored in tanks (not shown) until it is transferred to the crude unit 20, where it is heated by passage through a plurality of heat exchangers (not shown) to increase the temperature of the crude oil 1 to approximately 300° prior to entering a desalter 2. The heat exchangers increase the temperature of the crude oil 1 while, reducing the temperature of the finished product. Crude oil enters a desalter 2 where salt is removed, or washed, from the crude. The crude oil, now called desalted crude, is pumped through additional heat exchangers, raising the temperature to above 450° F., before entering a flash tower 6. In the flash tower 6, light and heavy hydrocarbons and contaminants contained in the crude oil are vaporized, or flashed, and are thus separated from the desalted crude. Naphtha or light hydrocarbons are then separated from the heavy hydrocarbons, such as kerosene.

The flashed light hydrocarbons carrying some heavy hydrocarbons containing contaminates, including kerosene and phosphorous rise through the flash tower 5 while the flashed desalted crude falls to the bottom of the flash tower. The upper portion of the flash tower 6 contains a plurality of fractionation trays 22 wherein the vaporized hydrocarbons will condense based on their boiling points and contamination levels. The higher fractionization trays condense the lighter hydrocarbons.

The heavier hydrocarbons containing the contaminants such as phosphorous will condense and begin to fall back down through the fractionation trays 22, toward the bottom of the flash tower 6. A total draw tray 25 is in position below the fractionation trays 22 to catch any falling condensed hydrocarbons before they remix with the flashed desalted crude. The total draw tray 25 is designed such that vapors can pass upward through chimneys 27 but condensed hydrocarbons cannot pass downward. The condensed hydrocarbons are prevented from passing through the chimneys 27 by means of chimney caps 29. The chimney caps direct condensed hydrocarbons away from the chimneys 27 and up to the total draw tray 25. The condensed hydrocarbons contained by the total draw tray 25 pool at exit point 30 for further processing. Thus, the heavy condensed hydrocarbons containing the contaminants such as phosphorus bypass downstream vessels, including the crude heater 8. The light hydrocarbons or naphtha is condensed in an overhead receiver 16 and then transferred to a naphtha stripper 14 where light naphtha and heavy naphtha are separated. The light naphtha is further sent to debutanizer 12 intended to separate the propane and butane contained in the light naphtha.

The crude oil from the flash tower 6, now called flashed crude, is pumped through additional heat exchangers, and on to a crude heater 8. By removing kerosene and ensuring that all of the water content is reduced from the crude, the phosphorous fouling of the heat exchanger and crude heater is reduced significantly. The outlet of the crude heater 8 is piped directly to the crude tower 10, where the crude oil is separated into finished products.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

The invention claimed is:

1. An apparatus for use in refining crude oil containing phosphorus and reducing the levels of phosphorus in the process of refining comprising:

a flash tower for receiving crude oil heated above 450° F. below a total draw tray, wherein the crude oil is separated, by flash separation, into vaporized hydrocarbons and a flashed crude;

a crude tower;

a plurality of fractionation trays and the total draw tray positioned below the plurality of fractionation trays within the flash tower, to catch recondensed hydrocarbons and any contaminants contained therein, the total draw tray preventing the recondensed hydrocarbons and contaminants from falling below the total draw tray and remixing with the flashed crude;

piping engaged with the total draw tray for removing the condensed hydrocarbons and contaminants and transferring the condensed hydrocarbons and contaminants directly to a crude tower; and a crude heater for receiving and heating the flashed crude and transferring the flashed crude to the crude tower.

* * * * *